United States Patent [19]

Srivatsa et al.

[11] 4,426,877

[45] Jan. 24, 1984

[54] METHOD AND APPARATUS FOR RECOVERING OIL FROM WASTE OIL EMULSION

[76] Inventors: Sanjay R. Srivatsa, 1620 Bay Ct., Naperville, Ill. 60565; Edwin C. Zuerner, Jr., 450 Van Gogh, Bolingbrook, Ill. 60439

[21] Appl. No.: 354,172

[22] Filed: Mar. 3, 1982

[51] Int. Cl.[3] ..... G01N 11/00

[52] U.S. Cl. ..... 73/54; 137/92

[58] Field of Search ..... 73/54, 55, 59; 137/92, 137/4

[56] References Cited

U.S. PATENT DOCUMENTS 3,025,232 3/1962 Jones, Jr. ..... 137/92 X

*Primary Examiner*—Gerald Goldberg
*Assistant Examiner*—Joseph W. Roskos
*Attorney, Agent, or Firm*—Lloyd L. Zickert; John G. Premo

[57] ABSTRACT

A method for recovering oil from a waste oil emulsion or sludge where the waste oil emulsion is heated and chemicals are added to obtain oil-water resolution, which includes conducting bottle and beaker tests on waste oil emulsion samples to obtain a trend which depicts a drop in viscosity as a function of the type and dosage of chemical added, and apparatus for utilizing the waste oil emulsion viscosity trend in the operation of a waste oil cooker or recovery vessel to add type and dosage of chemicals.

6 Claims, 4 Drawing Figures

"n", NON-NEWTONIAN INDEX
"k", BULK VISCOSITY COEFFICIENT
1.0
0.5
0.4
0.3
0.2
0.1
1.2
1.0
0.5
0.4
0.3
0.2
0.1
0
2000
4000
6000
n
k
1000ppm $H_2SO_4$ + N-7718

"n", NON-NEWTONIAN INDEX
"k", BULK VISCOSITY COEFFICIENT
1.0
0.5
0.4
0.3
0.2
0.1
1.2
1.0
0.5
0.4
0.3
0.2
0.1
0
2000
4000
n
k
12
10
$H_2SO_4$ ppm

METHOD AND APPARATUS FOR RECOVERING OIL FROM WASTE OIL EMULSION

This invention relates in general to a method and apparatus for obtaining the maximum oil recovery from a waste oil emulsion or sludge with the minimum addition of chemicals, and more particularly to an oil recovery system which monitors waste oil emulsion viscosity to control the addition and mixing in of accurate amounts of chemicals.

Heretofore, it has been well known to recover oil from waste oil emulsions by heating the waste oil emulsion and adding chemicals to produce an oil-water resolution. It has also been known to use as those chemicals an acid/caustic and an emulsion breaker. Further, it has been known to conduct bottle tests on waste oil emulsion to determine by observation of those tests the approximate proportion of chemical addition to obtain the best possible oil recovery. These methods, however, have been based on a trial-and-error type of procedure as learned from the bottle tests which has generally resulted in a substantially lower oil recovery from waste oil cookers than what was accomplished by the best bottle test.

Such waste oil emulsions are generated in manufacturing plants utilizing water, oil and other materials for machining and working of metals and the like. More particularly, such waste oil emulsions are found in refineries, hydrocarbon processing industries, steel mills, automotive plants and other industrial operations where oil is used. Examples of such waste oil emulsions are automotive waste oil skimmings, dissolved air flotation oily scum, waste oil emulsions from rolling mill operations, refinery slop oils, and waste oil sludges from refiners. Because of the value of the oil and the economics of a waste oil recovery program, it is worthwhile to recover as much oil as possible from any waste oil emulsion so that it can be reused. These waste oil emulsions include oil, water and rag, the latter being whatever materials are present in the waste oil emulsion other than and including oil and water. The usual method of breaking down the waste oil emulsion requires heating the waste oil emulsion to a desired temperature, mixing in a proportion of acid/caustic, mixing in a proportion of emulsion breaker and then allowing the waste oil emulsion to resolve, whereby the oil comes to the top and can be drawn off. Generally a concentrated sulphuric acid is used. A typical emulsion breaking chemical used in a waste oil recovery system would be one of the 7700 Series made by Nalco Chemical Company of Oak Brook, Ill., which are considered to be waste oil emulsion breakers designed to resolve emulsions where oil is the continuous phase.

The oil recovery system of the present invention achieves oil-water resolutions in a waste oil emulsion or sludge cooker or any other types of waste oil recovery system that is substantially similar to those obtained in bottle tests by incorporating bench scale viscosity measurements of the waste oil emulsion samples and using those viscosity trends to program the type and dosage addition of chemicals in the cooker. It will be recognized that the invention can be used with any batch waste oil recovery vessel, as well as a system using a continuous treatment by monitoring the viscosity and the break. A relationship between viscosity and oil-water resolutions was discovered, and which is utilized in the oil recovery system of the invention. Addition of the proper amount of chemicals minimizes oil recovery. Optimum chemical dosages are determined as a function of viscosity. At the same time, it was found that adding an excessive amount of one or more chemicals would reduce oil recovery. Thus, adding and mixing in given amounts of chemicals at critical times as a function of viscosity maximizes oil recovery and minimizes chemical usage, while at the same time prevents chemical overdosing.

The technique of the invention involves conducting bottle tests on samples of the cooker waste oil emulsion to visually observe viscosity and resolution, scaling up to a beaker test which utilizes a viscometer for measuring viscosity as is done in the cooker so that a trend can be obtained to determine the optimum chemical dosage for maximum oil recovery, and then applying this trend to the operation of a waste oil emulsion cooker so that the maximum oil recovery can be obtained.

Based upon the technique of the invention, another feature of the invention is to provide an apparatus for monitoring a waste oil emulsion cooker operation and adding chemicals as a function of the waste oil emulsion viscosity.

Accordingly, it is an object of the present invention to predict the oil-water resolution in a batch cooker or waste oil recovery vessel by conducting bench scale viscosity tests and applying the results in operating the cooker.

Another object of the invention resides in developing viscosity trends for a waste oil emulsion sample by conducting bottle and beaker tests which include heating the waste oil emulsion and adding chemicals and recording the viscosities at the various stages of the tests.

It is a further object of the present invention to recover oil from a waste oil emulsion or sludge by adding types and dosages of chemicals as a function of waste oil emulsion viscosity.

A still further object of the present invention to provide a new and improved oil recovery system so that the correct addition and mixing of emulsion breaking chemicals can be made to a waste oil emulsion at critical times to obtain maximum oil recovery.

Another object of the present invention is to provide a method for obtaining maximum oil recovery from a waste oil emulsion which controls the addition and mixing in of emulsion breaking chemicals as a function of the waste oil emulsion viscosity.

A further object of the present invention is to provide a technique for predicting oil-water resolutions in waste oil emulsion cookers wherein emulsion breaking chemicals are added in accordance with the waste oil emulsion viscosity.

Another object of the invention is to provide an apparatus for utilizing a viscosity trend in the operation of a waste-oil emulsion cooker or oil recovery vessel.

Other objects, features and advantages of the invention will be apparent from the following detailed disclosure, taken in conjunction with the accompanying sheets of drawings, wherein like reference numerals refer to like parts, in which.

Figure 3:
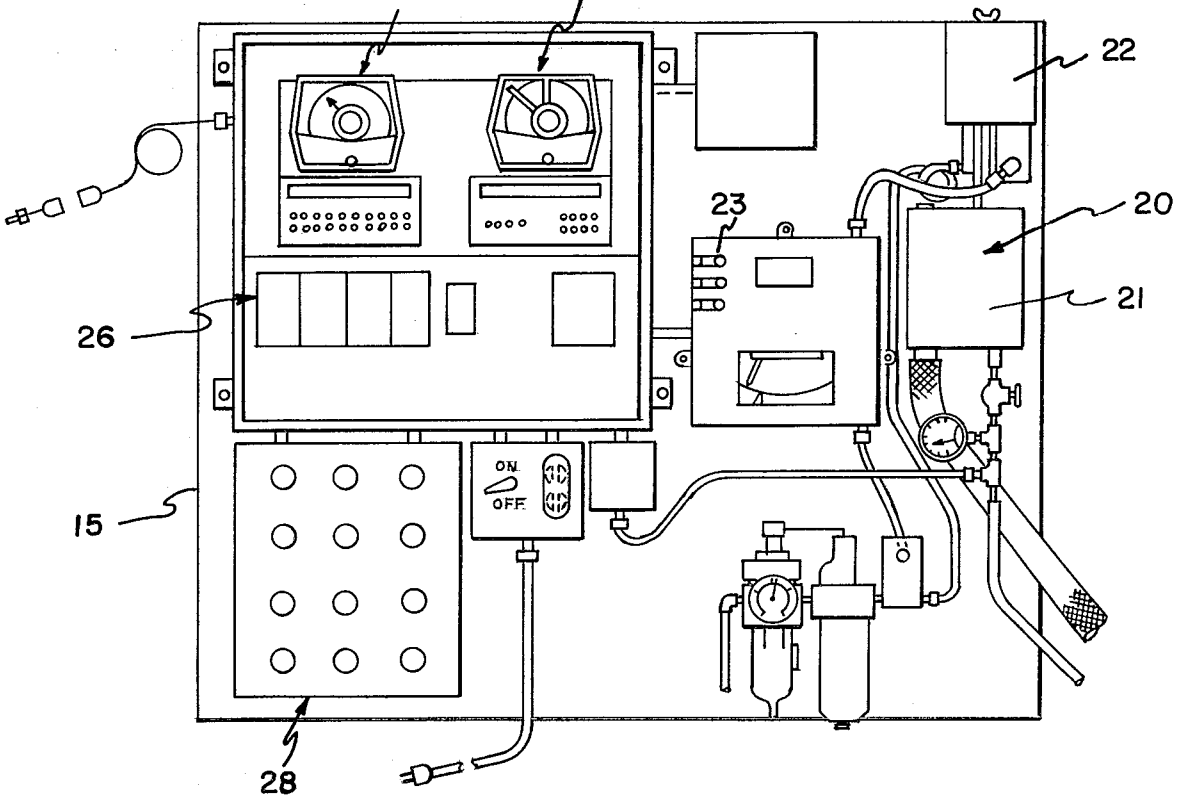
Figure 4:
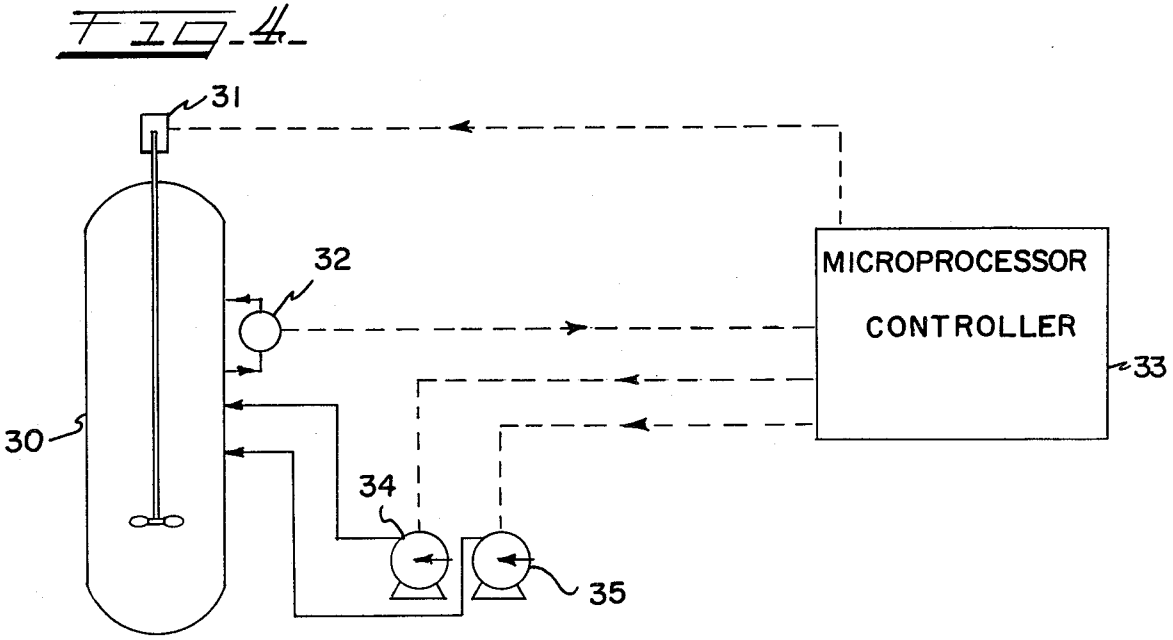

FIG. 3 is a front elevational view of instrumentation and equipment employed in the operational control of a batch cooker according to the oil recovery system of the present invention; and FIG. 4 is a schematic view of an oily waste oil emulsion cooker and apparatus for controlling the addition and mixing in of emulsion breaking chemicals as a function of the viscosity of the waste oil emulsion in the cooker.

The present invention concerns primarily an unique viscosity test for predicting oil-water resolutions in batch waste oil emulsion cookers, although it may equally well apply to any other waste oil recovery system. The technique incorporates bench scale viscosity measurements of waste oil samples at every step of chemical addition, thereby establishing a trend for operating the batch cooker to obtain the maximum amount of oil recovery.

The transport properties of a waste oil emulsion or sludge may be defined by reference to the terms "n" and "k", where "n" constitutes the index for non-Newtonian behavior and "k" constitutes the bulk viscosity co-efficient. Collectively, these parameters define the stability criterion for the emulsion. The terms "n" and "k" will have values ranging between zero and infinity. A waste oil system is believed to be pseudo-plastic where the value of n is between 0 and 1.0 and rheo-pectic where the value of n is between 1.0 and infinity. The waste oil system becomes Newtonian when the value of n approaches 1.0, at which time multiple phases cannot exist homogeneously, thus causing destabilization. Therefore, optimum conditions for oil-water resolution of a waste oil system occurs where there exists a definite minimum value for k and the value for n is closest to 1.0. This optimum region prescribes the exact amount of chemical mixing, heat duty, etc. that should be applied to the waste oil system to achieve incipient destabilization.

The values of k and n are obtained from a non-linear polynomial regression of shear stress and shear rate data applied to the classical power law for viscosity. The profiles of k and n indicate a maximum instability region corresponding to a low viscosity co-efficient (k value) which may be related to a low normal bulk viscosity for the waste oil emulsion system. Shear rate and shear stress values are measured by a highly sophisticated viscometer, and the viscosity equation employed herein is ($T=kG^n$). This equation relates shear stress to sheer rate in terms of viscosity using the constants k and n. The Greek letter tau (T) is the shear stress, while the Greek letter gamma (G) is the shear rate.

For a system like water, which has a linear stress/rate relationship, $n=1$ and then k becomes the viscosity of the water. For a system like a waste oil sludge, k varies depending upon the value of n. With the proper dosage of emulsion breaking chemicals such as acid and/or an emulsion breaker, when n approaches 1, the system becomes Newtonian where multiple phases cannot exist. Thus, a Newtonian system is one where only a single phase exists, and that is why separation occurs.

Figure 2:
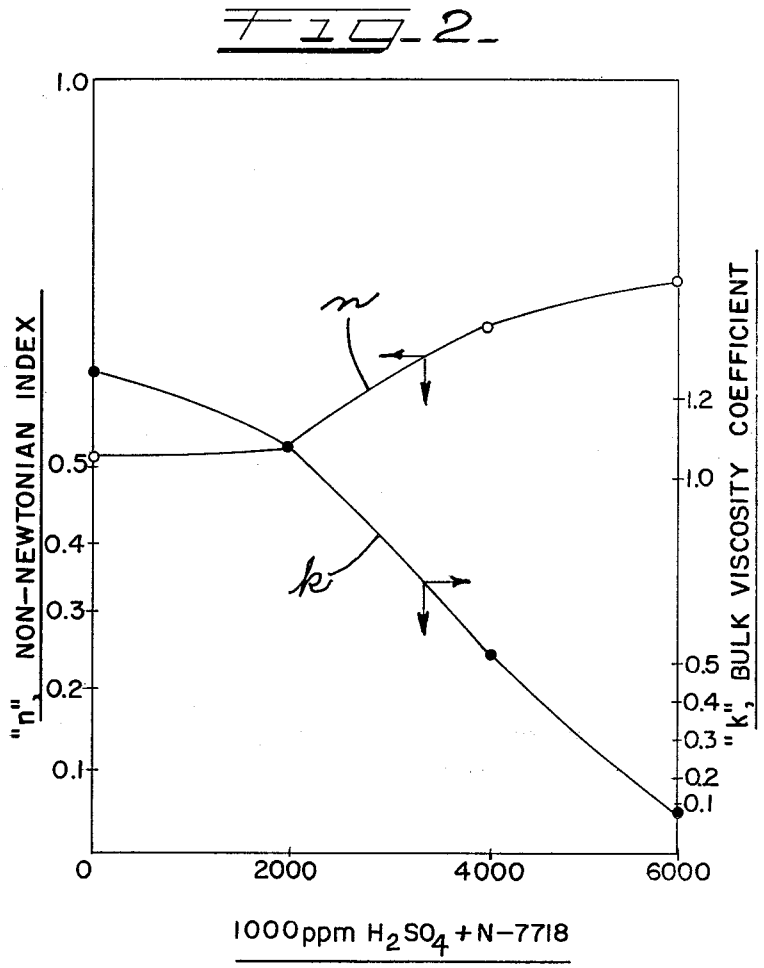
FIG. 2 is a chart similar to FIG. 1 but also incorporating the addition of an emulsion breaking chemical.
Figure 1:
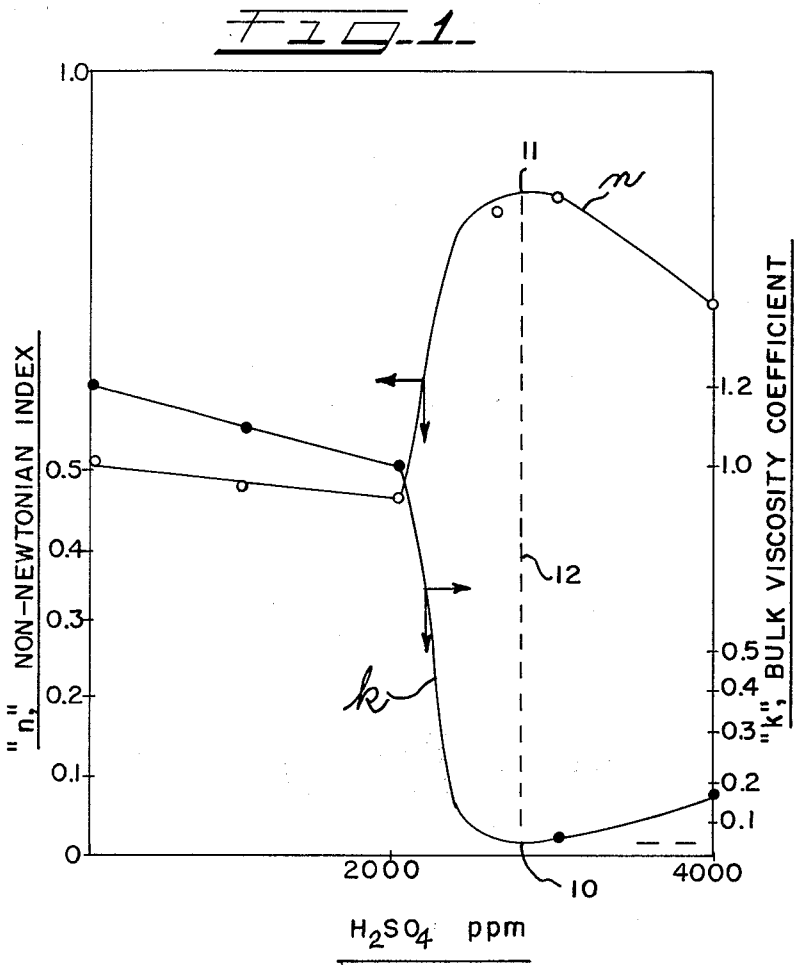
FIG. 1 is a chart illustrating the non-Newtonian index and bulk viscosity co-efficient of a waste oil emulsion as a function of the addition of acid to show the viscosity trend.

FIGS. 1 and 2 represent profiles of k and n on a waste oil emulsion system. The profiles of FIG. 1 result from the addition of acid only, while the profiles of FIG. 2 result from the addition of acid and an emulsion breaker. Following the k value in FIG. 1 as the acid quantity is increased, it is noted that the viscosity drops, and when it reaches the optimum dosage thereafter, the viscosity increases. The optimum dosage is at about 0.04 and indicated by the numeral 10. Conversely, the value of n increases with the incremental increases in addition of acid until it reaches an optimum high point at 11, about 0.87, and then commences to decrease. Thus, the optimum dosage of acid for this system is defined by the optimum line 12 and is related directly to a maximum value of n and a minimum value of k. Similarly, as illustrated in FIG. 2, where acid and emulsion breaker are added, the value of k decreases with the addition of emulsion breaker, while the value of n increases. It should be appreciated that the optimum conditions have not been obtained and plotted in FIG. 2. From the information documented in FIGS. 1 and 2, it can be appreciated that the optimum dosage is obtained in relation to the viscosity of the system.

The observations made from the data in FIGS. 1 and 2 leads to an understanding that the intangible phenomenon of destabilization of a system is reflected through a measurable dramatic reduction in the bulk viscosity of the system. Accordingly, the viscosity technique of the present invention for prediction of oil-water resolutions for treatment of waste oil emulsions was conceived.

The technique of the invention for predicting the oil-water resolution of a waste oil emulsion cooker operation involves the development of a viscosity profile or trend during bench tests and applying that trend to a cooker operation. Thereafter, monitoring of the viscosity of a waste oil emulsion in a cooker determines the critical times for adding critical amounts of emulsion breaking chemicals to optimize oil recovery. The general operation of a cooker would be to heat the waste oil emulsion to a desired temperature of about 180° F., adding in and mixing the emulsion breaking chemicals, maintaining the temperature of the mixture and allowing it to set for a period of time for the resolution of the oil.

The technique of the invention for predicting the oil-water resolution includes conducting bottle tests and thereafter conducting a beaker test in view of the bottle tests. A bottle constitutes a two-ounce jar. The bottle tests involve about two-ounce samples, while the beaker test involves about a 500 milliliter (ml) sample. It is important when conducting bottle and beaker tests to use containers having proportionately similar geometrical shapes like that of the cooker. Thus, a trend can be developed which will allow the minimum use of emulsion breaking chemicals and maximum oil recovery.

The bottle test is conducted by heating a sample of waste oil emulsion taken from the cooker to the cooker operation temperature and placing the sample in a plurality of two-ounce jars. Varying amounts of acid are added to the samples and mixed with the waste oil emulsion in desired increments. Likewise, various amounts of emulsion breaking chemical are then added to the samples and mixed, after which the viscosity of the samples is qualitatively observed.

Following the placement of the bottles in a water bath to maintain the temperature for a period of about twelve hours and observing the separation of water, oil and rag, the best resolved sample is then used for the beaker test.

The beaker test differs, however, in that viscosity is measured by a suitable viscometer as a viscometer is used in the cooker. It also may constitute a scaling up of the bench test to more approximate the conditions that will be present in the cooker.

A sample of the waste oil emulsion heated to the temperature to which the cooker will operate is placed in the beaker. A viscometer such as the standard Brookfield type is inserted into the sample to note an initial viscosity reading. The sample is then mixed well until a consistent or relatively constant viscosity reading is obtained. With the viscometer removed, acid is added in the amount determined by the best bottle test and thoroughly mixed into the sample. The viscometer is again inserted into the sample and the viscosity is noted. Additional mixing is conducted until the viscosity readings are consistently the same. The viscometer is then removed so that the second chemical can be added. In this instance an emulsion breaker is added and mixed thoroughly for a given period of time. Thereafter, the viscometer is reintroduced into the sample to take a viscosity reading. Thus, a trend is developed which depicts the drop in the viscosity of the waste oil emulsion sample as a function of the type and dosage of the product added.

The waste oil emulsion cookers generally incorporate steam for heating and mixing. In order to scale up the bottle test variables and reproduce bottle test results in the cookers, the cooker is first filled up and when half full the steam is turned on for mixing and heating. Normally, the waste oil emulsion reaches the desired temperature after a couple of hours. At that time the viscosity of a hot sample is measured. With steam still being introduced into the cooker, acid is added in the proportion used in the beaker test. After five to ten minutes of mixing, the viscosity drop can be measured. If the viscosity approximates that of the same measurement taken in the beaker, the emulsion breaking chemical can be added. With the steam still being introduced for mixing, a final viscosity measurement can be made after five to ten minutes. If the viscosity then approximates that obtained by the same steps in the beaker, the steam may be shut off and the cooker allowed to resolve for at least twelve hours.

The following examples illustrate the reliability of the technique to predict near accurate oil-water resolutions in the waste oil emulsion cookers.

EXAMPLE 1

Waste Oil Viscosity Survey from Automotive Plant A

Viscosity Trends
(Using a standard Brookfield Viscometer)
Average Temperature of sample = 180° F.

| Program | Viscosity of Lab Sample, cps. | Viscosity of Cooker Sample, cps. |
|---|---|---|
| Raw waste oil | 520 | 500 |
| Plus 1% sulphuric acid | 56 | 70 |
| Plus 1% sulphuric acid and 2000 ppm Nalco 7718 emulsion breaker | 16 | 20 |

Resolution Results

| | Oil | Water | Rag |
|---|---|---|---|
| Bottle test | 34% | 64% | 2% |
| Beaker test | 31% | 64% | 5% |
| Cooker No. 46 | 30% | 60% | 10% |

EXAMPLE 2

Waste Oil Viscosity Survey from Automotive Plant A

Viscosity Trends
(Using a standard Brookfield Viscometer)
Average Temperature of Sample = 180° F.

| Program | Viscosity of Lab Sample, cps. | Viscosity of Cooker Sample, cps. |
|---|---|---|
| Raw waste oil | 320 | 328 |
| Plus 1% sulphuric acid | 113 | 80 |
| Plus 1% sulphuric acid and 2000 ppm Nalco 7718 emulsion breaker | 40 | 40 |

Resolution Results

| | Oil | Water | Rag |
|---|---|---|---|
| Bottle test | 38% | 58% | 4% |
| Beaker test | 34% | 58% | 8% |
| Cooker No. 47 | 30% | 60% | 10% |

EXAMPLE 3

Viscosity Survey from Automotive Plant B

Test and Cooker Procedure

1. Obtain sample from cooker - measure viscosity
2. Heat sample to 130° F. - add acid in 2 oz. bottle - mix for 1 min. - heat sample to 150° F. - add 7710 - mix for 1 min. - allow to resolve
3. Provided program works, scale up test to 500 ml - heat to 130° F. - add acid - keep mixing until constant viscosity is measured
4. Heat cooker to 130° F. - add acid - mix until constant viscosity is recorded - compare with 500 ml test
5. Heat 500 ml sample to 150° F. - add 7710 - mix until constant viscosity is recorded
6. Heat cooker to 150° F. - add 7710 - mix until constant viscosity is recorded, compare with 500 ml test Chemical dosage from bottle test; 5000 ppm sulphuric acid; 2500 ppm Nalco 7710 emulsion breaker.

1. 2 oz. jar bottle test — 0.25 ml acid; 0.125 ml 7710
   Results — 62% oil, 30% water, 8% rag
2. 500 ml beaker test — 2.5 ml acid; 1.25 ml 7710
   Results — 60% oil, 30% water, 10% rag
3. Cooker test — capacity 3000 gal. - 15 gal. acid; 7.5 gal. 7710
   Results — 50–60% oil, 30% water, 10% rag

| Sample | Temp. (°F.) | Beaker Viscosity (cps.) | Mix Time (minutes) | Cooker Viscosity (cps.) | Mix Time (minutes) |
|---|---|---|---|---|---|
| Raw | 130 | 98.5 | | 98.5 | |
| Raw + Acid | 130 | 78 | 1 | 70 | 10 |
| | | 82 | 2 | | |
| Raw + Acid + 7710 | 150 | 63 | 1 | 48–54 | 10 |
| | | 63 | 2 | | |
| | | 61 | 4 | | |

Acid was added at lower temperature to avoid foaming.
Viscometer spindle speed is 100 rpm.

EXAMPLE 4

Viscosity Survey from Automotive Plant C

Test and Cooker Procedure

1. Obtain sample from cooker - measure viscosity
2. Add acid to sample in 2 oz. bottle at 68° F., heat to 160° F., add 7710 and allow to resolve (Mix sample for 1 min. at each chemical addition)
3. Provided program works, scale up test to 500 ml - add acid -

-continued mix - and measure constant viscosity at 68° F.
4. Add acid to cooker - mix and measure viscosity and compare to 500 ml sample
5. Heat 500 ml samples to 160° F. - mix and measure viscosity until constant
6. Heat cooker to 160° F. - measure viscosity and compare to 500 ml sample
7. Add 7710 to 500 ml sample and measure constant viscosity at 160° F.
8. Add 7710 to cooker at 160° F. and measure final viscosity
9. If final viscosity at any stage does not substantially correspond to viscosity of 500 ml samples, more chemical is added Chemical dosage from bottle test: 2500 ppm sulphuric acid; 2500 ppm Nalco 7710 emulsion breaker 1. Bottle test 0.125 ml acid; 0.125 ml 7710
   Results 37.3% oil, 44% water, 18.6% rag
2. Beaker test 1.25 ml acid; 1.25 ml 7710
   Results 33% oil, 46.4% water, 20.6% rag
3. Cooker test capacity - 2000 gal.; 5 gal. acid; 5 gal. 7710
   Results 35% oil, 50% water, 15% rag

| Sample | Temp. (°F.) | Viscometer Spindle Speed | Beaker Viscosity # (cps.) | Mix Time (min.) | Cooker Viscosity # (cps.) | Mix Time (min.) |
|---|---|---|---|---|---|---|
| Raw | 68 | (5) | 1670 | — | 1670 | — |
| Raw & Acid (prior to heating) | 68 | (1) | 8750 | 1 | 8750 | 2–5 |
| Raw & Acid (post heat) | 160 | (1) | 290–300 | — | 270 | 2–5 |
| Raw & Acid + 7710 | 160 | (100) | 28–33 | 1, 2, 3 | 46* | 2–5 |

*After 7 minutes of mixing, viscosity did not change, thus ½ gal. of 7710 was added to the cooker, and after 5 minutes of mixing, final viscosity was lowered to 38 cps.

A typical instrumentation grouping for controlling a cooker operation is shown in FIG. 3, which includes a panel 15 on which controls and instruments are maintained for monitoring and manually controlling the cooker operation.

A temperature control 16 is preset, after which following heat applied to the waste oil emulsion, the waste oil emulsion will be brought to a preset temperature and maintained during the initial stages of the cooker operation. A suitable source of steam is connected to the cooker for heating and agitating the waste oil emulsion. The temperature indicator 17 provides a direct readout of the temperature of the waste oil emulsion. Both the temperature control and temperature indicator are suitably connected by electrical hardware to the cooker.

A viscometer 20 continually monitors the viscosity of the waste oil emulsion by continually sampling the waste oil emulsion and checking viscosity. This viscometer includes a sampling tank 21 with a viscometer of the gravitational piston type 22 associated with the container and a readout gauge 23 which directly shows the viscosity of the sample being monitored. Suitable plumbing interconnects the sample container of the viscometer to the cooker, and a suitable pump provides the exchange of waste oil emulsion in the container.

Electronic detecting devices 26 serve to detect the temperature set point and the viscosity set points to alert the operator for operation of the control station 28. The operator starts a cooking operation by turning on the heat for the waste oil emulsion and turning on the temperature instrumentation and the viscometer. When the temperature reaches a set point, a horn is sounded and the "start acid feed" light is illuminated alerting the operator. The "alarm off" button on the control station is depressed to silence the horn and a button is depressed to start the acid feed manually. Mixing is carried on during the feed of the acid. When the acid concentration increases to a point to drop the viscosity to a first set point range, a "stop acid feed start emulsion breaker feed" light is illuminated. Additionally, a short blast of the horn is sounded at intervals to further alert the operator. After silencing the horn, the operator discontinues acid feed and commences the manual feed of emulsion breaker. Again, the viscosity drops as the emulsion breaker concentration increases. When a second viscosity set point is reached, a short horn blast accompanied by illumination of a "stop emulsion breaker feed turn off power" indicator light tells the operator to discontinue the feed of the emulsion breaker and to turn off the power, thereby completing a cooking cycle. The set points will be made according to the viscosity trend or profile developed by the bench scale viscosity tests.

An automatic control apparatus is schematically illustrated in FIG. 4. The cooker 30 is provided with a mixer 31 and a viscosity probe 32, both of which are interconnected into a microprocessor control 33. A first chemical pump 34 is connected between a supply of chemicals and the cooker and would be generally utilized to pump a first chemical such as acid into the cooker. A second chemical pump 35 is likewise connected between a source of a second chemical and the cooker for pumping a second chemical such as Nalco emulsion breaker into the cooker. The operation of both chemical pumps is controlled by the microprocessor controller which is pre-programmed in accordance with the viscosity trend. It will be understood that the waste oil emulsion in the cooker is heated by steam to a desired temperature after which the microprocessor controller automatically controls the addition of chemicals and the mixing of the chemicals with the waste oil emulsion as a function of the viscosity of the waste oil emulsion. When the cooking operation is completed, the microprocessor controller will discontinue the cooking operation.

From the foregoing, it will be appreciated that the present invention provides a unique technique to predict oil-water resolutions for waste oil emulsions as a function of the types and dosages of emulsion breaking chemicals added in accordance with a viscosity trend or profile established in bench tests. Use of the viscosity trend enhances the optimum recovery of oil from a waste oil emulsion with the optimum dosage of chemicals.

It will be understood that modifications and variations may be effected without departing from the scope of the novel concepts of the present invention, but it is understood that this application is to be limited only by the scope of the appended claims.

The invention is hereby claimed as follows:

1. A method of obtaining oil-water resolutions in waste oil emulsion cookers comprising the steps of, conducting bottle tests on waste oil emulsion samples to determine the optimum addition of acid and emulsion breaker, to obtain the optimum oil recovery, conducting a beaker test on a waste oil emulsion sample to better approximate the cooker operation and obtain a viscosity trend to determine the type and optimum dosages of acid and emulsion breaker, and programming the cooker operation in accordance with the trend to add acid and emulsion breaker of given quantities at given times as a function of waste oil emulsion viscosity.

2. The method of claim 1, wherein the step of conducting bottle tests including the steps of dividing the waste oil emulsion sample into a plurality of substantially equal relatively small waste oil emulsion quantities, adding and mixing in variable amounts of acid to the waste oil emulsion quantities, visually observing the viscosities of each quantity, adding and mixing variable quantities of emulsion breaker to said mixtures of waste oil emulsion and acid, and observing the viscosities of each final mixture.

3. The method of claim 2, wherein the step of conducting a beaker test includes the steps of scaling up the bottle test and placing several times the bottle quantity of the heated sample into a beaker, mixing the sample until a constant viscosity is obtained and measuring the viscosity with a viscometer, adding and mixing in a quantity of acid as determined from the bottle test to produce the desired viscosity, measuring the viscosity of the mixture of the sample and acid, adding and mixing in a quantity of emulsion breaker determined from the bottle test to produce the desired viscosity, and measuring the viscosity of the mixture of the sample, acid and emulsion breaker, thereby developing a trend depicting the drop in viscosity as a function of the type and dosage of acid and emulsion breaker added.

4. A method of predicting oil-water resolutions in waste oil emulsion recovery systems comprising the steps of, heating a waste oil emulsion sample to the operating temperature of the system, conducting bottle tests on the sample which includes dividing the waste oil emulsion sample into a plurality of substantially equal relatively small waste oil emulsion quantities, adding and mixing in variable amounts of acid to the waste oil emulsion quantities, visually observing the viscosities of each quantity, adding and mixing variable quantities of emulsion breaker to said mixtures of waste oil emulsion and acid, observing the viscosities of each final mixture, conducting a beaker test by scaling up the bottle test and placing several times the bottle quantity of the heated sample into a beaker, mixing the sample until a constant viscosity is obtained and measuring the viscosity with a viscometer, adding and mixing in a quantity of acid as determined from the bottle test to produce the desired viscosity, measuring the viscosity of the mixture of the sample and acid, adding and mixing in a quantity of emulsion breaker determined from the bottle test to produce the desired viscosity, and measuring the viscosity of the mixture of the sample, acid and emulsion breaker, thereby developing a trend depicting the drop in viscosity as a function of the type and dosage of acid and emulsion breaker added.

5. Apparatus for operating a waste oil emulsion cooker for treating a batch of waste oil emulsion which comprises, means for applying heat to the cooker to raise the temperature of said emulsion to a predetermined set point and thereafter maintaining the waste oil emulsion temperature at the predetermined set point, means for triggering and alarm when the set point is reached, a viscometer for continually monitoring the viscosity of the waste oil emulsion, means for feeding acid to the waste oil emulsion, means for triggering a second alarm when a predetermined viscosity value is reached to indicate sufficient acid has been added, means for feeding emulsion breaker to said waste oil emulsion, and means triggering a third alarm when a second predetermined viscosity value is reached to indicate sufficient emulsion breaker has been added.

6. Apparatus for automatically operating a waste oil emulsion cooker to treat a batch of waste oil emulsion commensurate with a viscosity trend established by bench scale tests, which apparatus comprises a viscosity probe in the cooker for continually measuring waste oil emulsion viscosity in the cooker, first and second sources of chemicals such as acid and emulsion breaker connected to the cooker with control means for selectively feeding the chemicals into the cooker, and a microprocessor controller programmed with the viscosity trend and interconnected with the viscosity probe and chemical control means to accurately control feeding of the chemicals to the cooker as a function of viscosity.

* * * * *

UNITED STATES PATENT AND TRADEMARK OFFICE

CERTIFICATE OF CORRECTION

PATENT NO. : 4,426,877

DATED : January 24, 1984

INVENTOR(S) : Sanjay R. Srivatsa and Edwin C. Zuerner, Jr.

It is certified that error appears in the above—identified patent and that said Letters Patent is hereby corrected as shown below:

Front page, please add --Assignee: Nalco Chemical Company, a Delaware corporation, Oak Brook, Illinois--

Col. 2, line 1, change "minimizes" to --maximizes-- line 40, after "invention" insert --is--

Signed and Sealed this

*Twenty-second* Day of *May 1984*

[SEAL]

*Attest:*

GERALD J. MOSSINGHOFF

*Attesting Officer*

*Commissioner of Patents and Trademarks*